US012808635B2

(12) United States Patent
Hall

(10) Patent No.: US 12,808,635 B2
(45) Date of Patent: Nov. 24, 2026

(54) PORTABLE BALLISTIC-RESISTANT SHIELD

(71) Applicant: Hallas IP Group, LLC, Sheridan, WY (US)

(72) Inventor: Kennith Hall, Las Vegas, NV (US)

(73) Assignee: HALLAS IP GROUP, LLC, Sheridan, WY (US)

( * ) Notice: Subject to any disclaimer, the term of this patent is extended or adjusted under 35 U.S.C. 154(b) by 36 days.

(21) Appl. No.: 19/000,335

(22) Filed: Dec. 23, 2024

(65) Prior Publication Data

US 2025/0257983 A1 Aug. 14, 2025

Related U.S. Application Data

(60) Provisional application No. 63/636,708, filed on Apr. 19, 2024, provisional application No. 63/552,403, filed on Feb. 12, 2024.

(51) Int. Cl.
*F41H 5/08* (2006.01)

(52) U.S. Cl.
CPC ..... *F41H 5/08* (2013.01)

(58) Field of Classification Search
CPC ..... F41H 5/08
See application file for complete search history.

(56) References Cited

U.S. PATENT DOCUMENTS

| | | | | |
|---|---|---|---|---|
| 2016/0290770 | A1* | 10/2016 | Martinez | F41H 5/08 |
| 2017/0307337 | A1* | 10/2017 | Boyd, III | A45C 1/00 |
| 2018/0202771 | A1 | 7/2018 | Armellino, Jr. | |
| 2020/0025526 | A1* | 1/2020 | Seuk | F41H 5/02 |
| 2021/0254934 | A1 | 8/2021 | Hadtke | |
| 2021/0270574 | A1 | 9/2021 | Bopp | |
| 2021/0330060 | A1 | 10/2021 | Miller | |
| 2022/0136805 | A1* | 5/2022 | McMurray | B32B 27/365 89/36.02 |
| 2023/0228536 | A1 | 7/2023 | Tervola | |
| 2023/0417513 | A1 | 12/2023 | Boydd | |

* cited by examiner

*Primary Examiner* — J. Woodrow Eldred

(57) ABSTRACT

In one example, a portable shield includes a first cover, a second cover, a panel, and a retention system. The second cover is configured to couple to the first cover and thereby from an enclosed cavity between the first and second covers. The panel is configured to fit entirely within the enclosed cavity and to prevent penetration of a projectile having a kinetic energy greater than 500 foot-pounds. The retention system is configured to bear the load of the panel and to hold the panel in a fixed place within the enclosed cavity.

16 Claims, 5 Drawing Sheets

PORTABLE BALLISTIC-RESISTANT SHIELD

RELATED APPLICATIONS

The present application claims priority to U.S. Provisional Patent Application No. 63/552,403, titled "Portable Ballistic Shield," filed Feb. 12, 2024, which is hereby incorporated by reference in its entirety, and to U.S. Provisional Patent Application No. 63/636,708, titled "Ballistic Shield with Retractable Bracket," filed Apr. 19, 2024, which is hereby incorporated by reference in its entirety.

BACKGROUND

Ballistic protection levels are classified according to industry standards, such as NIJ (National Institute of Justice) standards and ASTM (American Society of Testing and Material), indicating the type and velocity of projectiles the protection can withstand. These levels help guide the selection of personal protective equipment based on the expected threat level. Personal protective equipment can include handheld shields, for example. Such shields may be used, for example, by SWAT teams, bomb squads, police officers, military agencies, or by any other operator (including a civilian operator) that may be at risk of ballistic impact due to gunfire.

Some ballistic-resistant material, such as bullet-proof plates, are manufactured with holes or voids therein. While such holes or voids may facilitate attaching bolts, screws, or other fasteners to ballistic-resistant material, such features may also compromise the structural integrity and performance of the ballistic-resistant material.

SUMMARY

In one example, a portable shield includes a first cover, a second cover, a panel, and a retention system. The second cover is configured to couple to the first cover and thereby from an enclosed cavity between the first and second covers. The panel is configured to fit entirely within the enclosed cavity and to prevent penetration of a projectile having a kinetic energy greater than 500 foot-pounds. The retention system is configured to bear the load of the panel and to hold the panel in a fixed place within the enclosed cavity.

In another example, having a handle system configured to facilitate manual operation, the shield cover having a cavity having sufficient volume to receive a removable panel that meets the ballistic protection levels HG1, HG2, and RF1 of the National Institute of Justice Standard 0123.00. A retention system is removably coupled to the shield cover and configured to bear the load of the removable panel and to hold the removeable panel in a fixed place within the cavity.

BRIEF DESCRIPTION OF THE DRAWINGS

The same reference numbers or other reference designators are used in the drawings to designate the same or similar (functionally and/or structurally) features. The figures are not necessarily drawn to scale.

DETAILED DESCRIPTION

Figure 1:
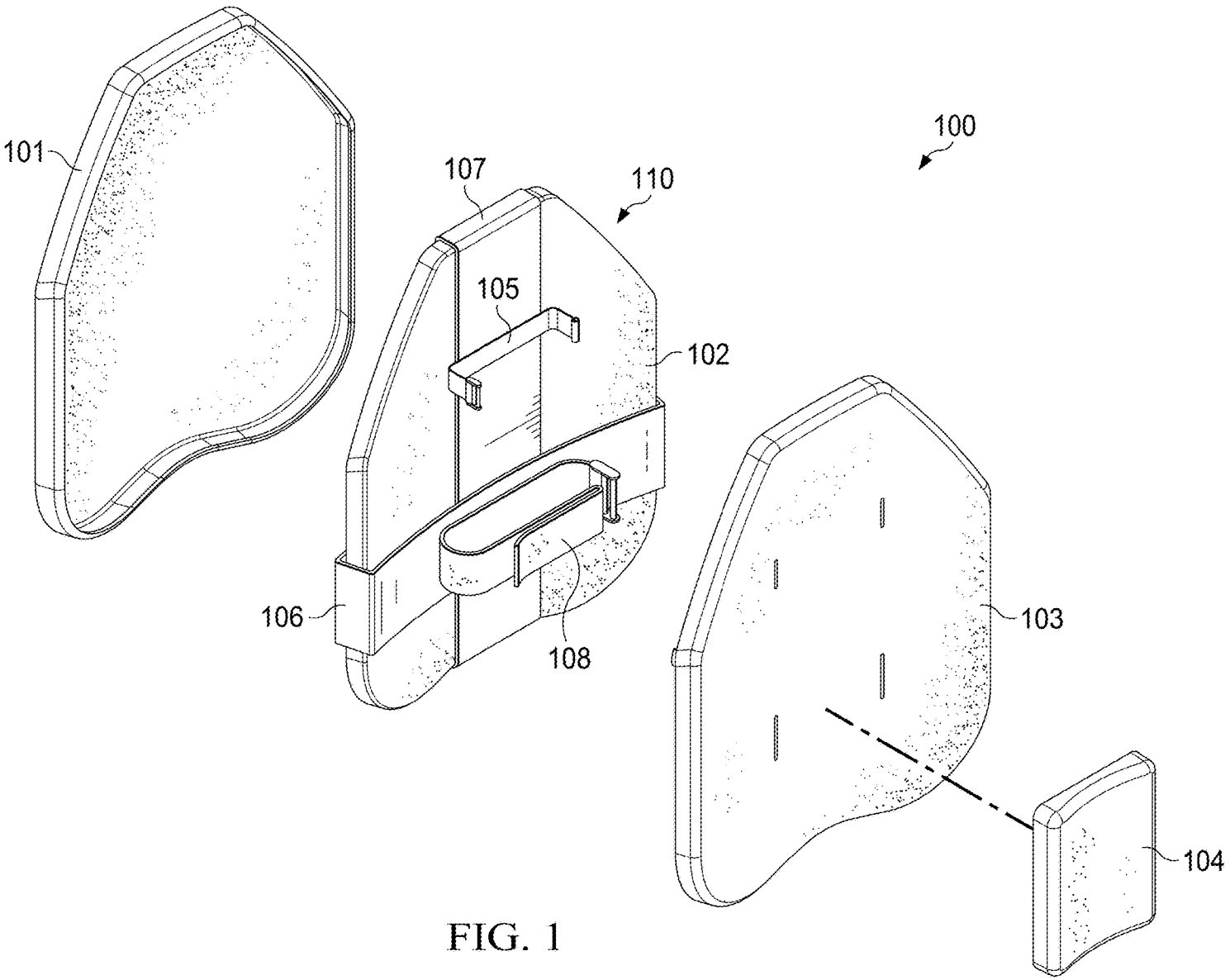
FIG. 1 is an exploded perspective view of a portable ballistic-resistant shield according to one example.

Various features are described hereinafter with reference to the figures. Other examples may include any permutation of including or excluding aspects or features that are described. An illustrated example may not have all the aspects or advantages shown. An aspect or an advantage described in conjunction with a particular example is not necessarily limited to that example and can be practiced in any other examples even if not so illustrated or if not so explicitly described.

The present disclosure relates generally, but not exclusively, to portable shields designed for personal protection against ballistic projectiles and associated threats. Ballistic projectiles can include, for example, ammunition fired by pistols, rifles, shotguns, or other firearms. Example portable ballistic-resistant shields are described in co-owned U.S. Pat. No. 12,152,863, filed Aug. 13, 2021, entitled "Load Bearing Cover for Integrating a Bolt Free Bullet Proof Protective Shield Having a Drop-Down Shield Cover Expansion Kit and Rifle Support Bracket and Method of use," which is incorporated herein in its entirety. Certain examples disclosed herein may have features substantially similar to the Compact Response Shield® of Armor Research Company, Inc.

Example portable ballistic-resistant shields disclosed herein can have any of a variety of advantageous features. Some features may collectively or individually enhance shield modularity, portability, ease of use, ergonomics, adaptability for various operators, adaptability for a variety of threats, and rapid deployment in dynamic hostile situations. In some examples, a portable shield is provided that is lightweight, compact, and easily deployable, allowing operators to effectively shield themselves from various ballistic threats while maintaining mobility and unobstructed sight lines. The shield can be employed to provide personal ballistic protection that is modular and highly adaptable to dynamic threats. The shield can employ unique ergonomics that facilitate on-the-move, offensive operator responses to active shooters and evolving situations that present potential armed engagement.

Certain example shields disclosed herein may offer personal protection for a variety of operators, such as law enforcement, military personnel, security teams, range instructors, marksman enthusiasts, civilian gun owners, and so forth. Certain operators face threats from firearm ballistics when in the line of duty. In some situations, operators have very little time to prepare for or assess a hostile situation. Although it may be standard practice for certain operators to wear soft body armor rated for a certain level of ballistic protection, some hostile situations may not present enough time for a responding operator to equip additional or different body armor rated for a higher level of ballistic protection.

The shield can have a lightweight cover (e.g., 2 pounds or less) designed to be durable and resilient in the field under various weather conditions. As described further below, the cover can have a variety of external features, such as, for example, Molle (modular lightweight load carrying equipment mount) webbing and stitching, front padding, a curved, ergonomic, high-impact forearm padding, a forearm strap, and an integrated handle. In addition, the shield cover can be customized by mounting various patches, pouches, equipment, or other accessories to the front or rear Velcro Molle.

In some examples, the shield cover can include first and second covers (e.g., front and back, respectively) that have manufacturing tolerances sufficiently loose to reduce complexity, manufacturing time, and product development cost, but that are tight enough to ensure high quality performance and reliability. Such optimized tolerances may lower production costs while increasing production capacity and yields.

The shield can be configured to carry one or more removable and swappable internal ballistic-resistant panels. Each panel can be configured to stop penetration of certain live rounds and other projectiles. For example, certain panels can be tested for compliance with NIJ Standard 0123.00 Level HG1, HG2, RF1, RF2, and/or RF3, as described further below. Additionally, or alternatively, certain panels can be tested for compliance with the prior NIJ Standard 0108.01 (e.g., for NIJ Levels I, II, IIIA, III, or IV), or to special threat testing for NATO 7.62×39 Type 56 MSC and 5.56 M193. Some panels may meet certain NIJ Standard criteria and nevertheless be lightweight (e.g., 10 pounds or less in total, including one or more internal panels). In some examples, each panel has a contiguous volume fully extending between its outermost edges, such that the panel has no holes or voids extending therethrough. The absence of such holes or voids within a panel may enhance its ballistic-resistant integrity, relative to alternative panels having such holes or voids.

In some examples, an operator can quickly modify a shield in terms of the number of panels used or the type of panel(s) used (e.g., in terms of ballistic protection level). This feature may facilitate a desired balance between weight and protection level against anticipated ballistic threats. In addition, one or more used or damaged panels can be quickly replaced (e.g., on the fly) with one or more new panels of similar or different levels of ballistic protection.

Some shields include a panel retention system. The panel retention system can be removably coupled to the shield cover and configured to partially or fully bear the load of the panel(s) and to hold the panel(s) in a fixed place within an internal cavity of the shield cover. In instances where multiple panels are used, the panel retention system may facilitate maintaining a collective fixed positioning and alignment of all panels within a shield cover. The panel retention system may further facilitate securing and protecting utility accessories within the shield cover, such as, for example, a trauma kit, a flashlight, or a communication system. The panel retention system may also facilitate the rapid swapping or replacement, and the consistent fixed positioning, of panels within a shield cover.

For additional coverage, an optional ballistic flip-down panel (e.g., as described in incorporated U.S. Pat. No. 12,152,863) can provide extended length and protection. The extension can be secured to the shield with malice clips in a hinge configuration. In some examples, the use of a ballistic flip-down panel can provide an additional coverage length of up to approx. 30 inches. The extension kit can be preconfigured with pistol or rifle rated ballistic panel inserts, for example.

In some examples, a shield is provided with a hands-free sling that allows an operator to transport or operate the shield in a variety of positions, including slung behind the operator in a back-protecting configuration. Certain shields are provided with straps configured to facilitate attachment to the driver or passenger side windows of a vehicle, thereby providing handsfree ballistic protection. The straps can be placed through outer D-rings located on the back of the shield and can be secured around the door window frame.

The manufacturing of certain ballistic-resistant shields often requires tight manufacturing tolerances, which can increase production costs and introduce lifetime reliability issues. Such issues may arise, for example, from fabric stretching or tearing over time or from the unintentional misplacement or detachment of equipment accessories. Certain examples disclosed herein address these and other technical issues.

FIG. 1 is an exploded perspective view of a portable ballistic-resistant shield 100 according to one example. Shield 100 includes a first cover 101, one or more ballistic-resistant panel(s) 102, a second cover 103, an energy-absorbing pad 104, a handle attachment strap 105, a horizontal load-bearing retention strap 106, a vertical load-bearing retention strap 107, and a retainer strap 108. First cover 101 may operate as a "front" cover facing away from the operator and second cover 103 may operate as a "back" cover facing toward the operator.

In some examples, handle attachment strap 105, horizontal load-bearing retention strap 106, vertical load-bearing retention strap 107, and retainer strap 108 are subcomponents of a panel retention system 110. Each subcomponent 105-108 of panel retention system 110 can individually operate, or all subcomponents 105-108 can collectively operate, to be load-bearing, including by bearing the load of panel(s) 102 retained by panel retention system 110. The panel retention system 110 can offer secure and dependable attachment for covers 101/103 and various features that optionally can be attached thereto (e.g., pad 104). Panel retention system 110 can be configured to securely fix in place and properly align one or more fully contiguous panel(s) 102 within a cavity between first and second shield covers 101/103. Such a feature may be contrasted, for example, with other shields having ballistic-resistant plates with holes or voids channeled therethrough (e.g., for attaching fasteners thereto), which could compromise ballistic-resistant integrity of the plates.

As shown in FIG. 1, shield 100 can incorporate one or more sloped or angled cutouts shaped to allow an operator to see or aim while remaining protected in areas both above and below the line of sight. In some examples, the cutouts are positioned between top and side edges of shield 100, from the perspective of an upright orientation of the shield 100. The use of cutouts can be distinguished, for example, from the use of transparent ballistic material for windows positioned proximate to a center of the shield, which can cause diffraction of incident light beams (and thereby reduce aiming accuracy), which can introduce impact variance, and which can expose an operator to a less protected, or even an unprotected, line of fire.

In some examples, shield 100 includes symmetric cutouts on both sides thereof. The use of symmetric cutouts on both sides of shield 100 may improve flexibility in operational use and accommodate both right-handed and left-handed primary operation. In the illustrated example, each cutout of shield 100 has a single outer edge having a first end joined to a top edge of the shield 100 and a second opposite end joined to a side of the shield 100, in which the majority of the outer edge of the cutout is aligned along a line that is at an angle (e.g., +/−45 degrees, or within the range of +/−30 degrees to +/−60 degrees) relative to respective lines most aligned to the top and side edges of shield 100. However, other cutout configurations may be used. For example, a cutout may include a first and second edges joined together at an internal angle within the range of 45 to 135 degrees (e.g., 90 degrees).

Shield 100 may be configured with the ability to mount accessories, such as a bracket designed to support a firearm (e.g., rifle or handgun). The firearm support accessories can be positioned proximate to a cutout at either side of the shield 100. Such a feature may enable an operator to use a sight picture consistent with the operator's training, which may improve accuracy and reduce training time. Example firearm support accessories are described further in incorporated U.S. Provisional Patent Application No. 63/636,708, titled "Ballistic Shield with Retractable Bracket."

Shield 100 can have a configurable design that facilitates manufacturing various sizes and weights, thereby offering flexibility for different tactical scenarios. Some examples can be configured to be lightweight, while nevertheless providing immediate and mobile ballistic protection to an operator. Shield 100 can be designed to be portable and quickly deployable, allowing an operator to move efficiently and adapt in dynamic situations.

As described further below, shield 100 can include a handle or grip for enhanced maneuverability and control while being used in a handheld configuration. In addition, shield 100 may have a modular design that allows the operator to customize the shield in accordance with operational needs. The modular design may facilitate, for example, the optional use of built-in lighting, communication systems, or attachment points for accessories.

Ballistic protection levels are classified according to industry standards, such as NIJ and ASTM, indicating the protective gear's ability to resist penetration. The table below specifies the test threats, the specific ammunition to be used, and the reference velocities to be used for NIJ Ballistic Protection Levels and Associated Test Threats, according to NIJ Standard 0123.00. In the table below, "HG" refers to handgun threats and "RF" refer to rifle threats.

| NIJ Level | Test Threat | Velocity | Approx. Kinetic Energy (in foot-pounds and Joules) |
|---|---|---|---|
| HG1 | 9 mm Luger FMJ RN 124 grain | 1305 ft/s (398 m/s) | 468.53 ft-lbf 635.81 Joules |
| | .357 Mag JSP 158 grain | 1430 ft/s (436 m/s) | 715.87 ft-lbf 969.5 Joules |
| HG2 | 9 mm Luger FMJ RN 124 grain | 1470 ft/s (448 m/s) | 593.2 ft-lbf 804.5 Joules |
| | .44 Mag JHP 240 grain | 1430 ft/s (436 m/s) | 1,086.5 ft-lbf 1,472.8 Joules |
| RF1 | 7.62 × 51 mm M80 Ball NATO FMJ Steel Jacket 147 + 0/−3 grain | 2780 ft/s (847 m/s) | 2,520.3 ft-lbf 3,413.5 Joules |
| | 7.62 × 39 mm MSC Ball Ammunition Type 56 from Factory 31 | 2400 ft/s (732 m/s) | 1,573.4 ft-lbf 2,131.5 Joules |
| | 5.56 mm M193 56 + 0/−2 grain | 3250 ft/s (990 m/s) | 1,308.4 ft-lbf 1,773.4 Joules |
| RF2 | 7.62 × 51 mm M80 Ball NATO FMJ Steel Jacket 147 + 0/−3 grain | 2780 ft/s (847 m/s) | 2,520.3 ft-lbf 3,413.5 Joules |
| | 7.62 × 39 mm MSC Ball Ammunition Type 56 from Factory 31 | 2400 ft/s (732 m/s) | 1,573.4 ft-lbf 2,131.5 Joules |
| | 5.56 mm M193 56 + 0/−2 grain | 3250 ft/s (990 m/s) | 1,308.4 ft-lbf 1,773.4 Joules |
| | 5.56 mm M855 61.8 ± 1.5 grain | 3115 ft/s (950 m/s) | 1,333.8 ft-lbf 1,806.9 Joules |
| RF3 | 30.06 M2 AP 165.7 + 0/−7 grain | 2880 ft/s (878 m/s) | 3,047.7 ft-lbf 4,131.5 Joules |

In the above table, the kinetic energy (Ek) of a projectile is calculated using the formula:

$$E_k = \frac{1}{2}mv^2$$

Where:

Ek is the kinetic energy in foot-pounds (ft-lbf) or Joules (J), m is the mass of the projectile in pounds (lbf) or kilograms (kg), v is the velocity of the projectile in feet per second (ft/s) or meters per second (m/s).

In some examples, shield 100 complies with one or more (or all) of the following NIJ Standard 0123.00 Levels: HG1, HG2, RF1, RF2, or RF3. In terms of absorbing kinetic energy, shield 100 may be capable of stopping a ballistic projectile having kinetic energy of 469 ft-lbf (636 J), 716 ft-lbf (970 J), 594 ft-lbf (805 J), 1,087 ft-lbf (1,473 J), 2,521 ft-lbf (3,414 J), 1,574 ft-lbf (2,132 J), 1,309 ft-lbf (1,774 J), 2,521 ft-lbf (3,414 J), 1,574 ft-lbf (2,132 J), 1,309 ft-lbf (1,774 J), 1,334 ft-lbf (1,807 J), or 3,048 ft-lbf (4,132 J). In terms of achieving certain kinetic energy stoppage thresholds, shield 100 may be tested to stop a ballistic projectile having a kinetic energy greater than or equal to 500 ft-lbf (677.91 J), 1,000 ft-lbf (1,355.82 J), 1,500 ft-lbf (2,033.73 J), 2,000 ft-lbf (2,711.64 J), 2,500 ft-lbf (3,389.55 J), or 3,000 ft-lbf (4,067.46 J). Stated in other terms, shield 100 may be capable of stopping a ballistic projectile having a kinetic energy less than or equal to 3,100 ft-lbf (4,203.04 J) or less than or equal to 2,600 ft-lbf (3,525.13 J). In some examples, shield 100 complies with one or more (or all) of the prior NIJ Standard 0108.01—i.e., NIJ Standard 0108.01 Levels I, II, IIIA, III, or IV.

Shield 100 may be used, for example, by SWAT teams, bomb squads, police officers, military agencies, or civilian applications that may involve ballistic impact due to gun fire. For example, shield 100 may be configured to provide protection to an operator who is advancing toward or retreating from a potentially dangerous situation, such as when providing cover during hostage rescues, active shooter incidents, or other high-threat environments.

Shield 100 may be deployed in a variety of hostile situations. In the event of an active shooter incident, for example, swift response is critical to saving lives by minimizing the duration between dispatch and engagement with the threat. Given the paramount importance of time once preventive measures are ineffective, certain examples include features facilitating deployment of a mobile ballistic barrier equipped with a rifle mount and adaptable for handgun support attachments. Shield 100 can thereby enhance safety for solo or multiple officer responders. Certain examples provide protection for a single operator, or for multiple operators working in tandem, in a manner that can significantly reduce response time, thereby limiting the window of opportunity for the threat to cause harm.

First and second covers 101/103 can include lightweight, durable, impact-resistant material designed to withstand certain impacts or physical assaults. For example, first and second covers 101/103 can each be constructed of 1000D Cordura; however, any suitable material may be used.

First and second covers 101/103 can be configured to couple to one another, thereby providing an enclosed cavity therebetween having sufficient volume to fully encase one or more panel(s) 102 and, optionally, additional utility accessories. As shown in FIG. 1, first and second covers 101/103 can be configured to couple together in a clamshell configuration, in which first cover 101 has a first lip extruded around all or most of a periphery edge thereof, second cover 103 has a second lip extruded around all or most of a periphery edge thereof, and the first and second lips are shaped and positioned to overlap with one another when the covers 101/103 are coupled together. The overlapping of respective lips can enable an outer surface of the lip of one cover 101/103 to form a friction fit or otherwise interlock within an inner surface of the lip of the other cover 101/103. The use of a clamshell configuration may allow for reduced tolerances in manufacturing, thereby lowering production costs while increasing production capacity and yields. Such a configuration may also facilitate, for example, the routing of any wires needed for attachable lights or other accessories.

In some examples, first and second covers 101/103 are fully detachable from one another, as shown in the exploded view of FIG. 1. In some examples, first and second covers 101/103 are rotatably connected together on respective ends thereof (e.g., via a hinge), and are configured to rotate toward or away from one another to facilitate sealing or accessing, respectively, an interior of shield 100. In some alternative examples, including the example described with reference to FIG. 4, first and second covers 101/103 are connected portions of a contiguous shield case having a sealable opening through which one or more panel(s) 102 may be inserted or removed as needed.

First and second covers 101/103 can be configured to couple and decouple from one another. Such a configuration may facilitate repeatedly accessing the interior of shield 100 as needed, making replacements or adjustments as desired to the interior of shield 100, and then reconnecting first and second covers 101/103. First and second covers 101/103 may include features to help secure the covers 101/103 in an interlocked configuration. Such features may include, for example, overlapping Velcro extending around the edge of shield 100, or straps extending around both first and second covers 101/103.

First cover 101 or second cover 103 (or both) can include a Molle feature, which can be laser cut on a respective surface thereof. The Molle feature can include Velcro including (e.g., on the inside lips and centerline). The Velcro can include a Velcro loop that is securely bonded to a backing material to enhance strength and durability. Once bonded, the configuration can be efficiently cut using either a laser or a clicker die, which can improve manufacturing speed and precision. The cooperative use of a Molle feature and Velcro may provide certain operational advantages. For example, such an example configuration can enable the secure fastening of heavier loads, while also accommodating lighter, easily accessible items that can be held solely by Velcro, thereby potentially improving versatility. Additionally, various identification panels can be effortlessly added or changed as needed.

Second cover 103 can include features for integrating one or more load-bearing straps. The load-bearing strap(s) may be configured to facilitate secure carrying and handling of the shield 100. For example, second cover 103 can include open slots extending therethrough to allow retainer strap 108 to be inserted and protrude therethrough.

Ballistic-resistant panel 102 generally refers to a protective component designed to absorb and deflect the impact of projectiles, such as fired ammunition, to prevent penetration. Panel 102 can be constructed from any suitable material(s) engineered and tested to withstand specific ballistic threats based on their rating. For example, panel 102 may include metallic material, such as titanium, stainless steel, carbon steel, or superalloys, for example. Panel 102 may additionally or alternatively include non-metallic material, such as Kevlar, Aramid fibers, ceramic tiles, or high-strength composites, for example. A given panel 102 may include a combination of metallic and non-metallic material. In addition, an operator may opt to include within a shield 100 different kinds of panels 102 at the same time, such as both metallic and non-metallic panels 102. Certain panel(s) 102 can have a contiguous design that is boltless or unperforated (i.e., lacks any holes or voids therethrough), thereby enhancing integrity and performance.

In some examples, a single panel 102, or a stack of multiple panels 102 aligned with one another, may provide sufficient ballistic protection for shield 100 to achieve compliance with one or more (or all) of the following NIJ Standard 0123.00 Levels: HG1, HG2, RF1, RF2, or RF3. In terms of absorbing kinetic energy, one or more panel(s) 102 may be individually or collectively capable of stopping a ballistic projectile having a kinetic energy of 469 ft-lbf (636 J), 716 ft-lbf (970 J), 594 ft-lbf (805), 1,087 ft-lbf (1,473 J), 2,521 ft-lbf (3,414 J), 1,574 ft-lbf (2,132 J), 1,309 ft-lbf (1,774 J), 2,521 ft-lbf (3,414 J), 1,574 ft-lbf (2,132 J), 1,309 ft-lbf (1,774 J), 1,334 ft-lbf (1,807 J), or 3,048 ft-lbf (4,132 J). In terms of achieving certain kinetic energy stoppage thresholds, use of a single panel 102, or use of stack of multiple panels 102 aligned with one another, may be tested to stop a ballistic projectile having a kinetic energy greater than or equal to 500 ft-lbf (677.91 J), 1,000 ft-lbf (1,355.82 J), 1,500 ft-lbf (2,033.73 J), 2,000 ft-lbf (2,711.64 J), 2,500 ft-lbf (3,389.55 J), or 3,000 ft-lbf (4,067.46 J). In some examples, use of a stack of one or more panel(s) 102 facilitates compliance with one or more (or all) of the prior NIJ Standard 0108.01—i.e., NIJ Standard 0108.01 Levels I, II, IIIA, III, or IV.

Panel 102 can have a curved shape (e.g., a concave surface curvature). For example, a panel 102 having a concave shape can have an inner surface that, when installed within shield 100, defines at least part of a gap between a central axis of an innermost (or only) panel 102 and second cover 103. The gap may be of sufficient size (e.g., a maximum length of 16 inches to 26 inches or a minimum, a maximum depth of 0.5 to 2.5 inches, and a maximum volume of 294 square inches to 364 square inches) to allow for the storage of various hardware, such as first-aid kits, a tourniquet, a communication system, a flashlight, or any other desired utility item. In a particular example, the gap is at least 1 inch by at least 16 inches. In addition, the gap between an innermost (or only) ballistic panel 102 and second cover 103 can enhance energy absorption during the dissipation of kinetic energy from high-energy ballistic projectiles (e.g., fired ammunition). The use of one or more curved panel(s) 102, in combination with certain other optional features of shield 100 (e.g., energy-absorbing pad 104), may further enhance dispersing kinetic energy and force vectors generated by high-velocity ballistic projectiles.

Energy-absorbing pad 104 can be configured for use as a shock absorber (e.g., responsive to the impact-effect of a ballistic projectile). In addition, pad 104 can be configured to protect the forearm from any back-face protrusions during a ballistic encounter. In some examples, pad 104 is configured for cooperative use with retainer strap 108, in which synching retainer strap 108 with an arm inserted therethrough wedges the pad 104 in place against an opposing surface of second cover 103. Pad 104 may additionally or alternatively be adjustably held in place against second cover 103 at a desired location using any suitable attachment mechanism, such as snaps or Velcro, for example.

In some examples, panel retention system 110 includes handle attachment strap 105, horizontal retention strap 106, vertical retention strap 107, and retainer strap 108, wherein each subcomponent 105-108 can individually operate, or all subcomponents can collectively 105-108 operate, to be load-bearing.

Handle attachment strap 105 can be configured (e.g., as part of panel retention system 110) to hold one or more ballistic panel(s) 102 in place between first cover 101 and second cover 103. In addition, handle attachment strap 105 can be configured to provide a solid mounting point of the overall retention system and can include protrusions configured to extend through corresponding openings in second cover 103. Handle attachment strap 105 also can be configured, for example, to help support the weight of the shield 100. In some examples, handle attachment strap 105 is permanently attached to vertical retention strap 107 (e.g., by sewing or gluing).

Horizontal retention strap 106 can be configured (e.g., as part of panel retention system 110) to hold ballistic panels 102 in place between first cover 101 and second cover 103. In addition, horizontal retention strap 106 can be configured to wrap around one or more panel(s) 102 in a lateral orientation. Horizontal retention strap 106 can be equipped with a buckle at one end, in which the buckle receives the other end of horizontal retention strap 106 and allows tensioning as desired before locking horizontal retention strap 106 in place (e.g., through the use of Velcro) with the desired tension.

Vertical retention strap 107 can be configured (e.g., as part of panel retention system 110) to hold one or more panel(s) 102 in place between first cover 101 and second cover 103. In addition, vertical retention strap 107 can be configured to wrap around one or more panel(s) 102 in a vertical orientation that is orthogonal to the wrapping direction of horizontal retention strap 106. Vertical retention strap 107 also can be configured to wrap around one or more panel(s) 102 in a horizontal orientation that is orthogonal to the lateral orientation of the horizontal retention strap 106. Vertical retention strap 107 can be equipped with a buckle at one end, in which the buckle receives the other end of vertical retention strap 107 and allows tensioning as desired before locking vertical retention strap 107 in place (e.g., through the use of Velcro) with the desired tension. In some examples, horizontal retention strap 106 and vertical retention strap 107 may be sewn or otherwise attached to one another in a cross-life configuration.

Retainer strap 108 can be coupled to the panel retention system 110 (e.g., by sewing to opposing portions of horizontal retention strap 106) and can be configured to provide solid mounting for use in manipulation of shield 100. Retainer strap 108 includes straps configured to be inserted through associated slots in the second cover 103. In some instances, retainer strap 108 can provide attachment points for the forearm and a handle for hardware. Retainer strap 108 can also have a Velcro loop attached in such a way as to provide attachment points for pad 104.

In some examples, the panel retention system 110 (including components 105-108) can be configured to not only hold one or more panel(s) 102 in place between first cover 101 and second cover 103, but also to secure shield 100 in place with the panel(s) 102 positioned at a desired protective location relative to the operator. In addition, the use of a panel retention system 110 (including components 105-108) that includes a retainer strap 108 extending through second cover 103 and outside of shield 100, may facilitate the use of certain rigid mounting features (e.g., on an operator-facing surface of shield 100) to which any of a variety of customizable accessories may be attached.

Figure 2:
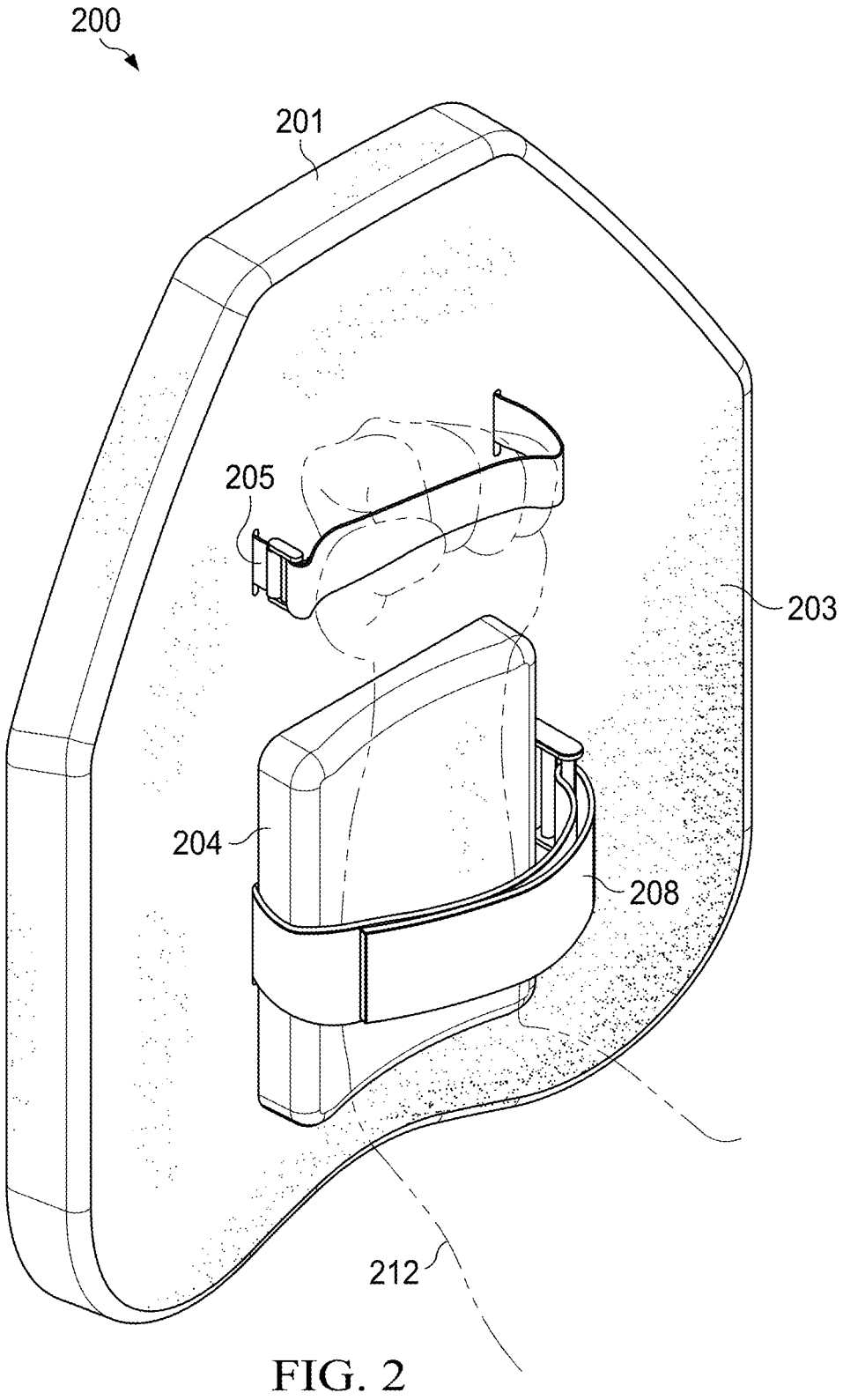
FIG. 2 is an operator-facing perspective view of a portable ballistic-resistant shield strapped to the arm of an operator, according to one example.

FIG. 2 is an operator-facing perspective view of a portable ballistic-resistant shield 200 strapped to the arm 212 of an operator, according to one example. In some examples, shield 200 may be substantially similar to shield 100 of FIG. 1. More specifically, subcomponents 201, 203, 204, 205 and 208 of FIG. 2 may be substantially similar to corresponding subcomponents 101, 103, 104, 105, and 108, respectively of FIG. 1.

Figure 3:
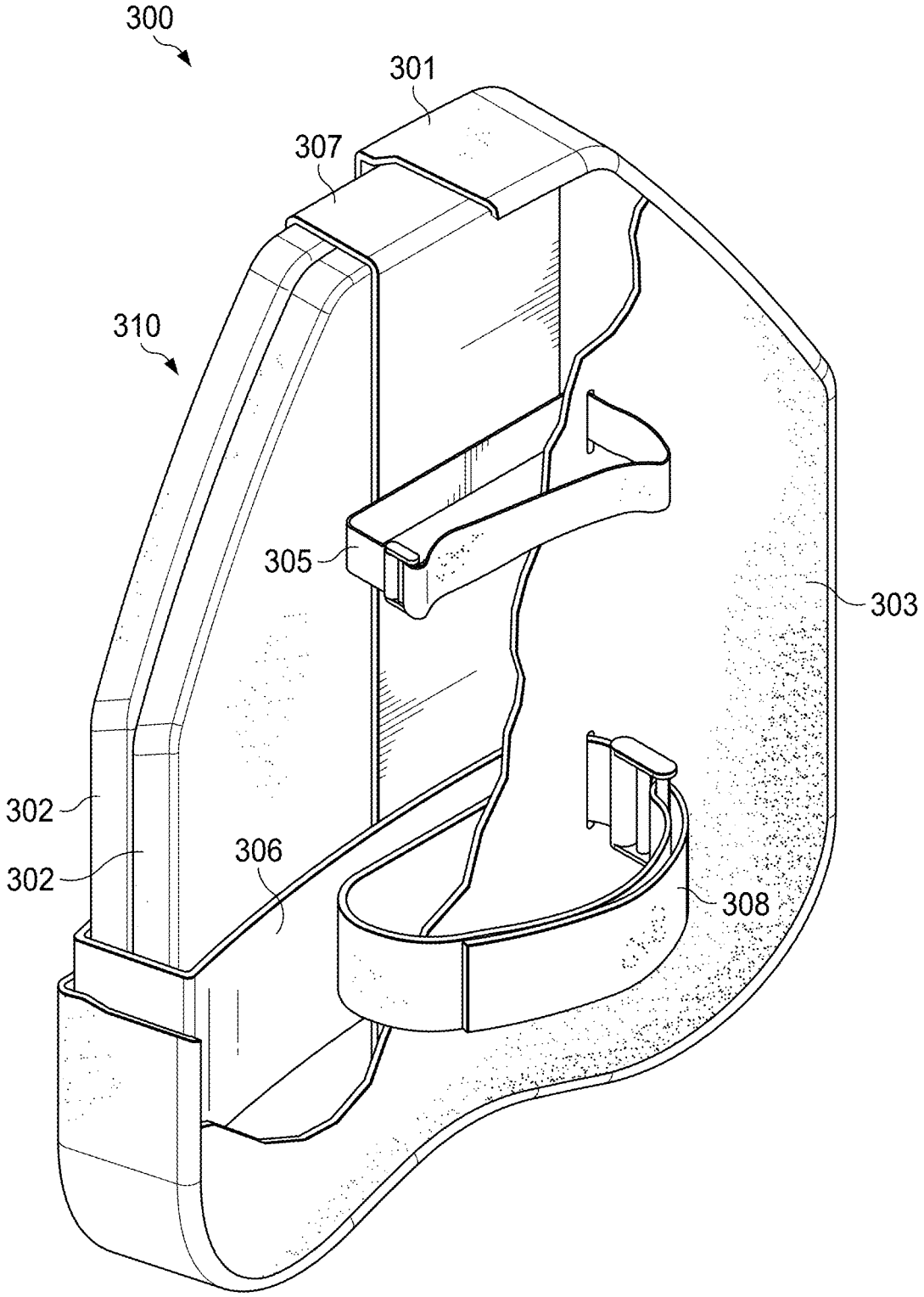
FIG. 3 is a cutaway view of a portion of a portable ballistic-resistant shield, in which a panel retention system is shown as retaining and aligning multiple ballistic-resistant panels, according to one example.

FIG. 3 is a cutaway view of a portion of a portable ballistic-resistant shield 300, in which a panel retention system 310 (including a handle attachment strap 305, a load-bearing retention strap 306, a vertical load-bearing retention strap 307, and a retainer strap 308) is shown as retaining and aligning multiple ballistic-resistant panels 302, according to one example. In some examples, shield 300 may be substantially similar to shield 100 of FIG. 1. More specifically, subcomponents 301, 302, 303, 305, 306, 307, 308, and 310 FIG. 3 may be substantially similar to corresponding subcomponents 101, 102, 103, 105, 106, 107, 108, and 110, respectively of FIG. 1.

Figure 4:
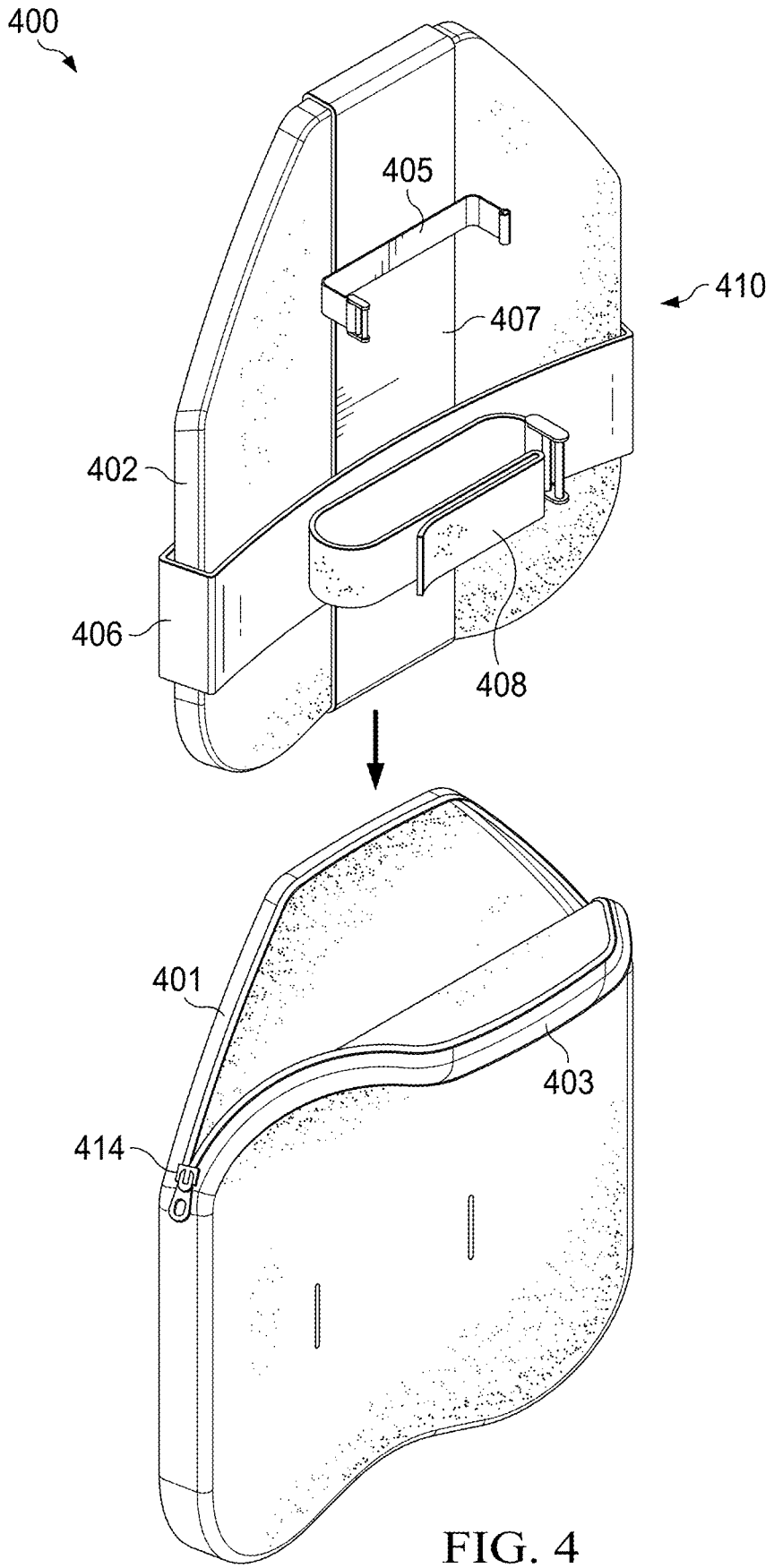
FIG. 4 is an operator-facing perspective view of a portable ballistic-resistant shield, in which a shield case has a sealable opening through which one or more panel(s) may be inserted or removed, according to one example.

FIG. 4 is an operator-facing perspective view of a portable ballistic-resistant shield 400, in which a shield case having opposing sides 401/403 has a sealable opening through which one or more panel(s) 402 may be inserted or removed, according to one example. In this example, a zipper 414 is used to seal the sealable opening between a front side 401 and an opposing and interconnected back side 403 of the shield case; however, any suitable sealing mechanism may be used (e.g., Velcro, a hinge and friction fit, etc.). The front and back sides 401/403 may be respective, permanently connected, and integrated portions of a shield case.

Shield 400 includes a panel retention system 410 including a handle attachment strap 405, a load-bearing retention strap 406, a vertical load-bearing retention strap 407, and a retainer strap 408. The panel retention system 410 (including subcomponents 405-408 thereof) may operate to securely fix in place and properly align one or more ballistic-resistant panel(s) 402 within a cavity between shield opposite sides 401/403. Such a feature may be contrasted, for example, with other shields having ballistic-resistant plates with holes or voids channeled therethrough (e.g., for attaching fasteners thereto), which could compromise ballistic-resistant integrity of the plates.

In some examples, certain features of shield 400 may be substantially similar to corresponding features of shield 100 of FIG. 1. For example, subcomponents 401, 402, 403, 405, 406, 408, and 410 may be substantially similar, in at least certain respects, to corresponding subcomponents 101, 102, 103, 105, 106, 108, and 110, respectively, of FIG. 1.

Figure 5:
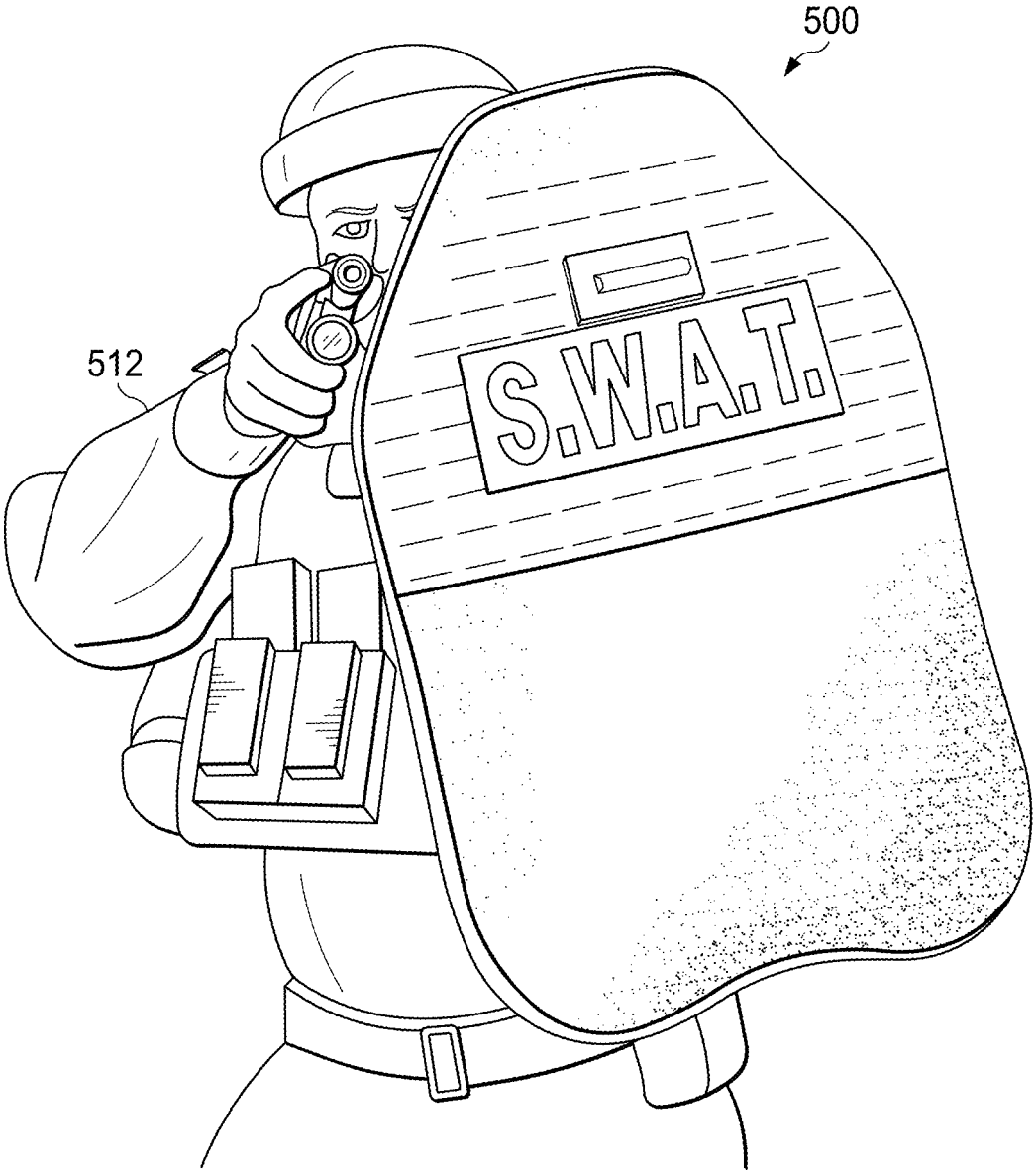
FIG. 5 is an outward-facing perspective view of a portable ballistic-resistant shield being equipped by an operator, according to one example.

FIG. 5 is an outward-facing perspective view of a portable ballistic-resistant shield 500 being equipped by an operator, according to an example. In some examples, portable ballistic-resistant shield 500 may be substantially similar to shield 100 of FIG. 1 and may have the same or substantially similar subcomponents as to those described above with reference to FIG. 1.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context. To aid the Patent Office, and any readers of any patent issued on this application, in interpreting the claims appended hereto, applicant notes that there is no intention that any of the appended claims invoke 35 U.S.C. § 112(f) as it exists on the date of filing hereof unless the words "means for" or "step for" are explicitly used in the claim language.

In the foregoing descriptions, for purposes of explanation, numerous specific details are set forth to provide a thorough understanding of one or more examples. However, this disclosure may be practiced without some or all these specific details, as will be evident to one having ordinary skill in the art. In other instances, well-known structures have not been described in detail in order not to unnecessarily obscure this disclosure. In addition, the foregoing description is not intended to limit the disclosure to the described examples. To the contrary, the description is intended to cover alterations, modifications, substitutions, and equivalents as may be included without departing from the scope defined by the appended claims.

What is claimed is:

1. A portable shield, comprising:

a first frame having a first sidewall extending from a first peripheral edge thereof;

a second frame having a second sidewall extending from a second peripheral edge thereof, the first sidewall configured to be nested within and overlap the second sidewall along at least a portion of the first and second peripheral edges, such that the first and second frames define a slot therebetween, the slot sized to accommodate at least a portion of a ballistic-resistant panel, the ballistic-resistant panel configured to prevent penetration of a projectile having a kinetic energy greater than 500 foot-pounds; and a retention system configured to retain the ballistic-resistant panel in place within the slot.

2. A portable shield, comprising:

a first cover;

a second cover configured to couple to the first cover and thereby form an enclosed cavity between the first and second covers;

a panel that fits entirely within the enclosed cavity, the panel configured to prevent penetration of a projectile having a kinetic energy greater than 500 foot-pounds; and a retention system configured to bear the load of the panel and to hold the panel in a fixed place within the enclosed cavity, the retention system including a retention strap configured to extend through first and second openings in the second cover.

3. The shield of claim 2, wherein the retention strap is configured to synch the shield against a forearm of an operator.

4. The shield of claim 2, wherein the retention strap includes a handle configured to removably attach hardware to the shield.

5. The shield of claim 2, wherein the retention strap is configured to couple an energy-absorbing pad to the shield.

6. The shield of claim 2, wherein the retention system includes first and second load-bearing straps arranged orthogonal to one another in a cross-configuration, the first and second straps each configured to wrap around the panel.

7. The shield of claim 2, wherein the retention system includes a load-bearing handle attachment strap configured to lock a position of the panel between the first and second covers.

8. The shield of claim 7, wherein the handle attachment strap includes first and second protrusions configured to extend through first and second openings, respectively, of the second cover.

9. The shield of claim 2, wherein the first cover has a top edge having a first length, and the first cover has a bottom edge having a second length greater than the first length.

10. The shield of claim 2, wherein the first cover has a cutout portion between a top edge of the first cover and a side edge of the first cover.

11. The shield of claim 2, further comprising a detachable firearm support configured to removably attach to the shield and to provide a shooting platform for a firearm.

12. The shield of claim 2, wherein the panel has a solid, unperforated volume between continuous opposing surfaces of the panel.

13. The shield of claim 2, wherein the panel includes multiple panels, and the retention system is configured to hold the multiple removable panels in alignment with one another within the cavity.

14. A portable shield, comprising:

a shield cover having a handle system configured to facilitate manual operation, the shield cover having a cavity having sufficient volume to receive a removable panel that meets the ballistic protection levels HG1, HG2, and RF1 of the National Institute of Justice Standard 0123.00; and a retention system removably coupled to the shield cover and configured to bear the load of the removable panel and to hold the removeable panel in a fixed place within the cavity, wherein the removeable panel includes multiple removeable panels, and the retention system is configured to hold the multiple removable panels in alignment with one another within the cavity.

15. The shield of claim 14, wherein the retention system is further configured to couple an energy-absorbing pad to an outer surface of the shield.

16. The shield of claim 14, wherein, when the removable panel has a concave surface curvature, such that, when held in the fixed place by the panel retention system, the concave surface curvature is spaced apart from an opposing inner surface of the shield cover by a gap at least 1 inch in length, the gap being orthogonal to the concave surface curvature along a central axis of the removable panel.

* * * * *